US010825392B2

(12) United States Patent
Chen et al.

(10) Patent No.: US 10,825,392 B2
(45) Date of Patent: Nov. 3, 2020

(54) DATA SIGNAL COMPENSATION METHOD FOR PIXEL CIRCUIT, DATA SIGNAL COMPENSATION DEVICE AND DISPLAY DEVICE

(71) Applicant: BOE TECHNOLOGY GROUP CO., LTD., Beijing (CN)

(72) Inventors: Yi Chen, Beijing (CN); Fei Yang, Beijing (CN); Song Meng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/395,715

(22) Filed: Apr. 26, 2019

(65) Prior Publication Data

US 2020/0105191 A1 Apr. 2, 2020

(30) Foreign Application Priority Data

Sep. 29, 2018 (CN) ..... 2018 1 1145796

(51) Int. Cl.
*G09G 3/3233* (2016.01)
*G09G 3/00* (2006.01)

(52) U.S. Cl.
CPC ..... *G09G 3/3233* (2013.01); *G09G 3/006* (2013.01); *G09G 2320/0233* (2013.01); *G09G 2330/12* (2013.01)

(58) Field of Classification Search
CPC ..... G09G 3/32; G09G 3/3208; G09G 3/325
See application file for complete search history.

(56) References Cited

U.S. PATENT DOCUMENTS 9,262,964 B2 2/2016 Nam et al.
2013/0162617 A1* 6/2013 Yoon ..... G09G 3/3233 345/211
2014/0320475 A1* 10/2014 Shin ..... G09G 3/3275 345/212
2017/0004764 A1* 1/2017 Kim ..... G09G 3/3233

FOREIGN PATENT DOCUMENTS

CN 104700772 A 6/2015

* cited by examiner

*Primary Examiner* — Kevin M Nguyen
(74) *Attorney, Agent, or Firm* — Kinney & Lange, P.A.

(57) ABSTRACT

Embodiments of the present disclosure provide a data signal compensation method for a pixel circuit, including: inputting a test signal to the data signal line, and detecting a real-time voltage at the first node after a first preset time elapses; comparing the real-time voltage with a preset voltage, and in response to the real-time voltage being deviated from the preset voltage, adjusting an initial compensation value for a mobility, so as to make the real-time voltage be consistent with the preset voltage, wherein the preset voltage is set by obtaining an initial threshold voltage for the driving transistor; generating a compensation test signal and inputting the compensation test signal to the data signal line; and generating a test signal, inputting the generated test signal to the data signal line, and sensing a first voltage at the first node after a first preset time elapses as the preset voltage.

12 Claims, 4 Drawing Sheets

DATA SIGNAL COMPENSATION METHOD FOR PIXEL CIRCUIT, DATA SIGNAL COMPENSATION DEVICE AND DISPLAY DEVICE

CROSS-REFERENCE TO RELATED APPLICATION(S)

This application claims the priority of Chinese Patent Application No. 201811145796.4, filed on Sep. 29, 2018, the entire contents of which are hereby incorporated by reference.

TECHNICAL FIELD

Embodiments of the present disclosure relate to the field of display technologies, and in particular, to a data signal compensation method for a pixel circuit, a data signal compensation device and a display device.

BACKGROUND

An AMOLED (Active Matrix Organic Light Emitting Diode) display device is a current driving device. Each pixel in the display device has a driving transistor (TFT), so as to control a brightness of an OLED by controlling a driving current flowing to the OLED based on the data signal. However, due to various factors such as process conditions and driving environments of the driving TFT being different, the driving currents inputted into the AMOLED which result from the same data signal may be not the same, resulting in a deviation between display brightness of different pixels.

SUMMARY

According to one aspect of embodiments of the present disclosure, there may be provided a data signal compensation method for a pixel circuit, the pixel circuit comprising a switching sub-circuit, a driving transistor, a memory sub-circuit, and a detecting sub-circuit, wherein the switching sub-circuit is coupled to a scanning signal line, a data signal line, and the driving transistor, and configured to enable to connect the data signal line to the driving transistor electrically under a control of a scanning signal from the scanning signal line; the driving transistor has a gate electrically coupled to the switching sub-circuit, a drain coupled to a first voltage terminal, and a source coupled to a first node, and is configured to generate a driving current in response to a data signal from the data signal line; the memory sub-circuit is coupled to the gate of the driving transistor and the first node; the detecting sub-circuit comprises a resetting transistor and a first capacitor, the resetting transistor having a controlling terminal coupled to a resetting controlling line, a first terminal coupled to the first node and a second terminal coupled to a first electrode of the first capacitor and a sensing signal line, and the second electrode of the first capacitor being grounded, wherein:

the data signal compensation method comprising:

inputting a test signal to the data signal line, and detecting a real-time voltage at the first node after a first preset time elapses; and comparing the real-time voltage with a preset voltage, and in response to the real-time voltage being deviated from the preset voltage, adjusting an initial compensation value for a mobility of the driving transistor, so as to make the real-time voltage be consistent with the preset voltage, wherein the preset voltage is set by:

writing a threshold test signal to the data signal line, so as to obtain an initial threshold voltage of the driving transistor;

generating a compensation test signal according to the initial threshold voltage, and inputting the compensation test signal to the data signal line, so as to obtain an initial compensation value for the mobility; and generating the test signal according to the initial threshold voltage and the initial compensation value, inputting the generated test signal to the data signal line, and sensing a first voltage at the first node after the first preset time elapses as the preset voltage.

For example, writing the threshold test signal to the data signal line so as to obtain the initial threshold voltage of the driving transistor comprises:

inputting the threshold test signal to the data signal line;

sensing a voltage at the first node as a cutoff voltage in a state of the driving transistor being turned off; and obtaining the initial threshold voltage of the driving transistor according to the threshold test signal and the cutoff voltage.

For another example, the initial threshold voltage $V_{th}$ of the driving transistor is given by:

$$V_{th}=V_G-V_{S1}$$

wherein $V_G$ is a voltage value for the threshold test signal, and $V_{S1}$ is a voltage value of the cutoff voltage.

For another example, generating the compensation test signal according to the initial threshold voltage and inputting the compensation test signal to the data signal line so as to obtain the initial compensation value for the mobility comprises:

determining the compensation test signal $V_{data1}$ as $$V_{data1}=GL+V_{th}$$

wherein GL is a constant and $V_{th}$ is the initial threshold voltage of the driving transistor;

detecting a second voltage $U_2$ at the first node after a time interval $T_2$ elapses, and obtaining the initial compensation value K for the mobility by:

$$K=\frac{\mu_0}{\mu}=(GL)^2*\mu_0*U_2/T_2$$

wherein $\mu_0$ is a preset standard mobility and $U_2$ is the second voltage; wherein $U_2/T_2=i$, i is the driving current generated by the driving transistor in response to inputting the compensation test signal:

$$i=\mu*(V_{data1}-V_{th})^2=\mu*(GL+V_{th}-V_{th})^2=\mu*(GL)^2$$

wherein $\mu$ is an initial mobility for the driving transistor.

For another example, the test signal $V_{data2}$ is given by:

$$V_{data2}=\alpha*K+V_{th}$$

wherein K is the initial compensation value for the mobility of the driving transistor, $\alpha$ is a predetermined constant, and $V_{th}$ is the initial threshold voltage of the driving transistor, the driving current generated by the driving transistor in response to inputting the test signal $V_{data2}$ is given by:

$$i'=\mu*(V_{data2}-V_{th})^2=\mu*(\alpha*K+V_{th}-V_{th})^2=\mu*(\alpha*K)^2,$$

the first voltage is given by:

$$V_{S1}=T_1*i'=T_1*\mu*(\alpha*K)^2,$$

the preset voltage $Tag_1$ is given by:

$$Tag_1=V_{S1}=T_1*\mu*(\alpha*K)^2,$$

wherein $T_1$ is the first preset time.

For another example, adjusting the initial compensation value for the mobility of the driving transistor so as to make the real-time voltage be consistent with the preset voltage comprises:

decreasing the initial compensation value for the mobility, in response to the real-time voltage being greater than the preset voltage; or increasing the initial compensation value for the mobility, in response to the real-time voltage being less than the preset voltage; and repeating the decreasing or the increasing until the real-time voltage is equal to the preset voltage.

For another example, adjusting the initial compensation value for the mobility of the driving transistor so as to make the real-time voltage be consistent with the preset voltage comprises:

obtaining a deviation $\Delta V_{th}$ for the $V_{th}$ by:

$$\Delta V_{th} = \frac{\alpha * K}{2} * \frac{\Delta Tag}{Tag_1},$$

and $$\Delta Tag = Tag_2 - Tag_1$$

wherein $\alpha$ is a predetermined constant, K is the initial compensation value for the mobility, $Tag_2$ is the real-time voltage, and $Tag_1$ is the preset voltage; and obtaining a real-time threshold voltage of the driving transistor according to the deviation $\Delta V_{th}$, and inputting the real-time threshold voltage to the data signal line as the initial threshold voltage for the compensation test signal, so as to obtain a real-time compensation value for the mobility.

For another example, the data signal compensation method is performed in response to the data signal line having no data signal input or being provided with a data signal of a low level.

According to another aspect of the embodiments of the present disclosure, there may be provided a data signal compensation device for a pixel circuit, the pixel circuit comprising a switching sub-circuit, a driving transistor, a memory sub-circuit, and a detecting sub-circuit, wherein the switching sub-circuit is coupled to a scanning signal line, a data signal line, and the driving transistor, and configured to enable to connect the data signal line to the driving transistor electrically under a control of a scanning signal from the scanning signal line; the driving transistor has a gate electrically coupled to the switching sub-circuit, a drain coupled to a first voltage terminal, and a source coupled to a first node, and is configured to generate a driving current in response to a data signal from the data signal line; the memory sub-circuit is coupled to the gate of the driving transistor and the first node; the detecting sub-circuit comprises a resetting transistor and a first capacitor, the resetting transistor having a controlling terminal coupled to a resetting controlling line, a first terminal coupled to the first node and a second terminal coupled to a first electrode of the first capacitor and a sensing signal line, and the second electrode of the first capacitor being grounded, wherein the data signal compensation device comprising:

a correction sub-circuit coupled to the data signal line and the sensing signal line electrically;

wherein the correction sub-circuit is configured to: obtain an initial threshold voltage for the driving transistor by writing a threshold test signal to the data signal line; generate a compensation test signal according to the initial threshold voltage, and input the compensation test signal to the data signal line, so as to obtain an initial compensation value for a mobility; and generate a test signal according to the initial threshold voltage and the initial compensation value, input the generated test signal to the data signal line, and sense a first voltage at the first node after a first preset time elapses as the preset voltage via the sensing signal line.

According to yet another aspect of the embodiments of the disclosure, there may be provided a data signal compensation device, comprising:

a memory configured to store instructions; and a processor electrically coupled to the memory, a data signal line, and a sensing signal line, wherein the processor is configured to execute the instructions stored in the memory to:

input a test signal to the data signal line, and detect a real-time voltage at the first node after a first preset time elapses;

compare the real-time voltage with a preset voltage, and in response to the real-time voltage being deviated from the preset voltage, adjust an initial compensation value for a mobility of the driving transistor, so as to make the real-time voltage be consistent with the preset voltage, wherein the preset voltage is an initial threshold voltage of the driving transistor obtained by writing a threshold test signal to the data signal line, wherein the processor is further configured to:

generate a compensation test signal according to the initial threshold voltage, and input the compensation test signal to the data signal line, so as to obtain an initial compensation value for the mobility; and generate the test signal according to the initial threshold voltage and the initial compensation value, input the generated test signal to the data signal line, and sense a first voltage at the first node after the first preset time elapses as the preset voltage via the sensing signal line.

According to still another aspect of the embodiments of the present disclosure, there may be provided a display panel comprising the data signal compensation device discussed above.

According to another aspect of the embodiments of the present disclosure, there may be provided display device comprising the data signal compensation device discussed above.

BRIEF DESCRIPTION OF THE DRAWINGS

The embodiments of the present disclosure will be further described in detail below with reference to the accompanying drawings.

DETAILED DESCRIPTION

Figure 1:
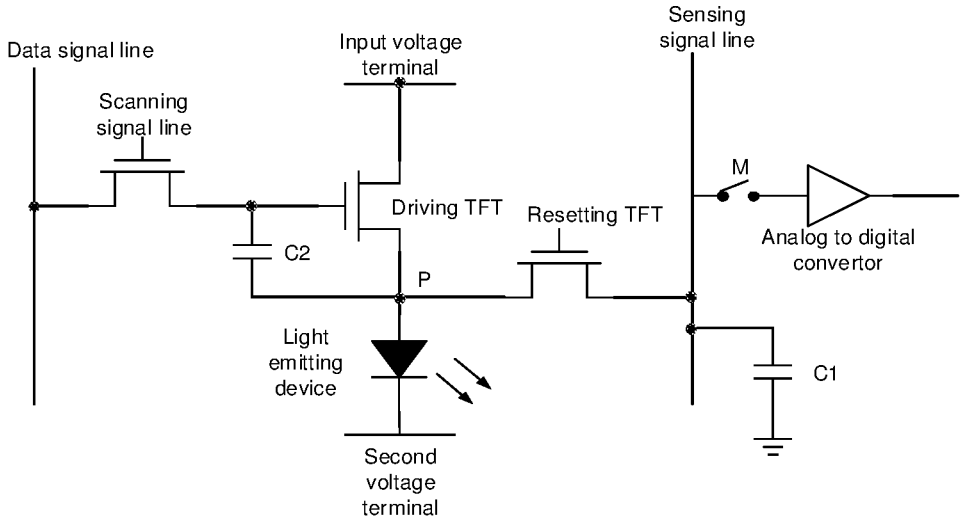
FIG. 1 shows a schematic diagram of a pixel circuit.

In order to illustrate the embodiments of the present disclosure more clearly, the embodiments of the present disclosure are further described below in conjunction with the preferred embodiments and the accompanying drawings. Similar components in the drawings are denoted by the same reference numerals. It should be understood by those skilled in the art that following detailed description is illustrative and non-limiting, thus should not be intended to limit the scope of the disclosure.

Referring to FIG. 1, a pixel circuit of an AMOLED display device may include a switching transistor (TFT) and a driving TFT. The switching TFT is coupled to a data signal line, a scanning signal line and a driving TFT, while the driving TFT is coupled to an input voltage terminal, the switching TFT and a light emitting device, respectively. The switching TFT electrically connects the data signal line to the driving TFT under a control of a scanning signal from the scanning signal line. The driving TFT is turned on in response to a data signal from the data signal line, so as to generate a driving current and input the generated driving current into the light emitting device. The light-emitting device emits light under the input driving current, thereby realizing a display function.

The driving TFT may have different parameter characteristics depending on process conditions and driving environments. Therefore, due to the fact that different pixels may generate different driving currents even if they are provided with the same data signal, there may be a deviation between display brightness of different pixels.

With respect to this problem, since the driving current generated by the driving TFT is mainly related to the threshold voltage and mobility of the driving TFT, current solutions mostly include detecting the threshold voltage of the driving TFT when powering off, and obtaining the mobility of the driving TFT according to the threshold voltage so as to compensate the mobility of the driving TFT, so that the driving currents generated by the driving TFTs included in respective pixels of the display device with the same data signal are enabled to be the same. Thus, it is possible to reduce the deviation between the display brightness of different pixels. However, the compensation for the mobility at present is usually achieved by detecting the threshold voltage of the driving TFT in an off state and then compensating according to the threshold voltage. When the display device is in a display state, the threshold voltage of the driving TFT may drift due to environmental factors such as temperature, causing the compensation for the mobility of the driving TFT to be inaccurate. Therefore, there will still be a deviation between the display brightness of the pixels.

According to an aspect of the embodiments of the present disclosure, there is provided a data signal compensation method for a pixel circuit. The pixel circuit includes a switching sub-circuit, a driving transistor, a memory sub-circuit, and a detecting sub-circuit. In the pixel circuit, the switching sub-circuit is coupled to a scanning signal line, a data signal line, and the driving transistor respectively; the driving transistor has a gate electrically coupled to the switching sub-circuit, a drain coupled to a first voltage terminal, and a source coupled to a first node P. The memory sub-circuit is coupled to the gate of the driving transistor and the first node P. Light emitting sub-circuit is coupled to the first node P and a real-time voltage terminal respectively, and the real-time voltage terminal can be a ground terminal. The detecting sub-circuit may comprise a resetting TFT and a first capacitor C1. In particular, the resetting TFT has a controlling terminal coupled to a resetting controlling line, a first terminal coupled to the first node P and a second terminal coupled to a first electrode of the first capacitor C1, wherein the second electrode of the first capacitor C1 is grounded. The first node P is further coupled to the sensing signal line. For example, the detecting sub-circuit may further include an analog to digital converter coupled to the sensing signal line. An analog voltage of the sensing signal line is converted to a digital voltage by the analog to digital converter for processing.

Figure 2:
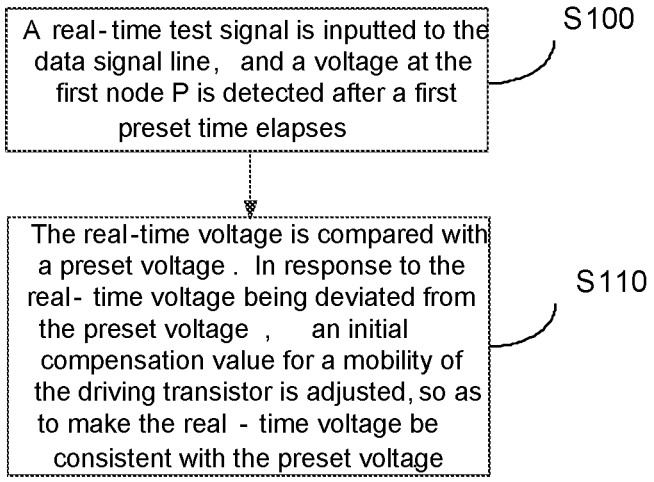
FIG. 2 shows a flow chart illustrating a specific embodiment of a data signal compensation method for a pixel circuit according to embodiments of the present disclosure.

As shown in FIG. 2, the data signal compensation method includes the following steps.

At S100, a test signal is inputted to the data signal line, and a real-time voltage at the first node P is detected after a first preset time elapses. For example, a reset controlling signal may be input to the gate of the resetting TFT through a resetting controlling line, and the resetting TFT may electrically connects the first node P with the first capacitor C1 in response to the resetting controlling signal. Thus, the first capacitor C1 starts charging, and the voltage at the first node P rises.

At S110, the real-time voltage is compared with a preset voltage. In response to the real-time voltage being deviated from the preset voltage, an initial compensation value for a mobility of the driving transistor is adjusted, so as to make the real-time voltage be consistent with the preset voltage. If the real-time voltage is deviated from the preset voltage, it indicates that there may be a change in the initial threshold voltage and the mobility of the driving transistor, thereby causing a failure of a static compensation scheme. Thus, it is necessary to re-determine the threshold voltage of the driving transistor, so as to determine the current compensation value for the mobility which can enable a uniform displaying of the display panel.

For example, in a case that the real-time voltage is deviated from the preset voltage, the initial compensation value for the mobility can be decreased in response to the real-time voltage being greater than the preset voltage; or the initial compensation value for the mobility can be increased in response to the real-time voltage being less than the preset voltage. The decreasing or the increasing can be repeated until the real-time voltage is equal to the preset voltage.

For example, adjusting the data signal according to the real-time voltage and the real-time compensation value, so as to make the real-time voltage be consistent with the preset voltage comprises:

obtaining a deviation $\Delta V_{th}$ for the $V_{th}$ by:

$$\Delta V_{th} = \frac{\alpha K}{2} \times \frac{\Delta Tag}{Tag_1}, \text{ and}$$

$$\Delta Tag = Tag_2 - Tag_1$$

wherein $\alpha$ is a predetermined constant, K is the initial compensation value for the mobility, $Tag_2$ is the real-time voltage, and $Tag_1$ is the preset voltage.

A real-time threshold voltage of the driving transistor is obtained according to the deviation $\Delta V_{th}$, i.e. $V_{th}=V_{th}+\Delta V_{th}$. Then, the real-time threshold voltage is input to the data signal line, so as to obtain a real-time compensation value for the mobility, thereby compensating the threshold voltage and the mobility of the driving transistor and improving the display uniformity of the pixel circuit.

Figure 3:
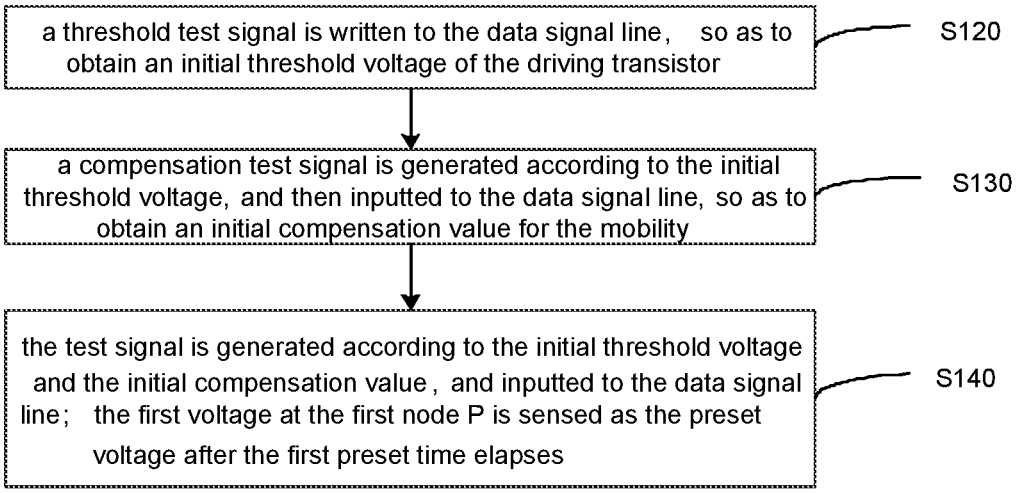
FIG. 3 shows a flow chart illustrating an operation for preset voltage measurement in a specific embodiment of the data signal compensation method according to the embodiments of the present disclosure.

Among them, a preset voltage can be set before compensating for the mobility and the threshold voltage. As shown in FIG. 3, the preset voltage can be set by the following steps.

At S120, a threshold test signal is written to the data signal line, so as to obtain an initial threshold voltage of the driving transistor.

Figure 4:
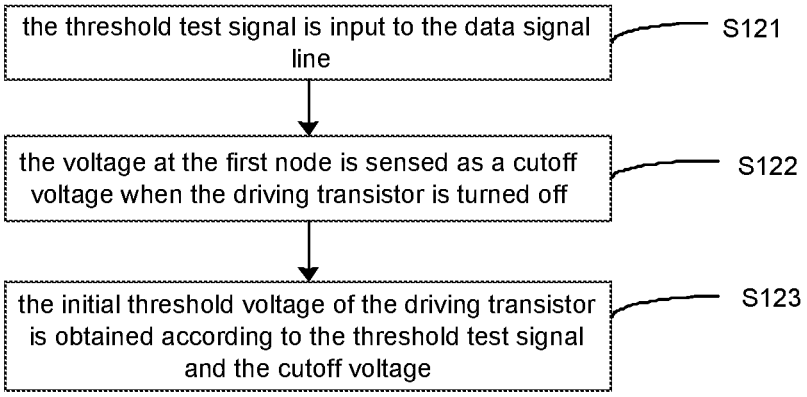
FIG. 4 shows a flow chart illustrating an operation for obtaining an initial threshold voltage of a driving transistor in one example of the data signal compensation method according to the embodiments of the present disclosure.

As shown in FIG. 4, the operation of S120 may further include the following steps.

Figure 5:
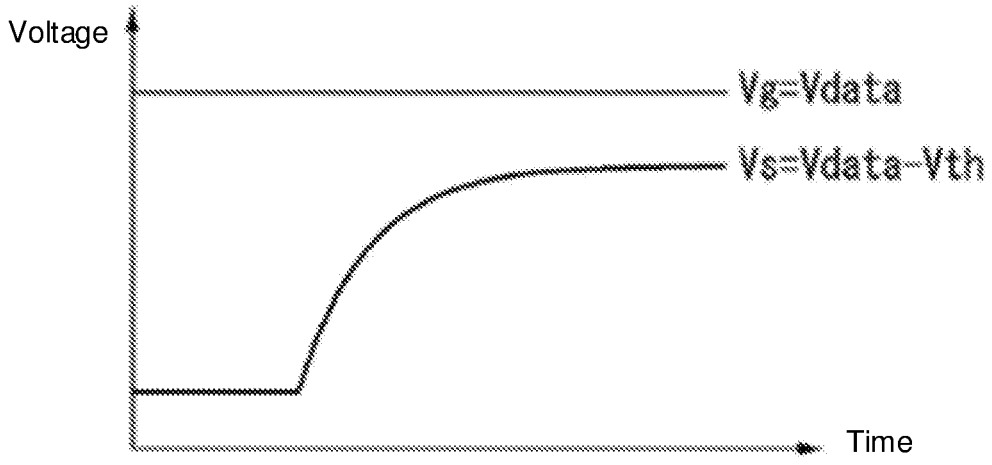
FIG. 5 shows a schematic diagram for charging a first capacitor in one example of the data signal compensation method according to the embodiments of the present disclosure.

At S121, the threshold test signal is input to the data signal line. For example, the switching sub-circuit can be controlled to electrically connect the data signal line with the driving TFT, and can input a resetting voltage $V_{ref}$ to the sensing signal line. Since $V_{ref}$ is smaller than a voltage of the threshold test signal $V_G$ from the data signal line, the driving TFT is turned on. Thus, the current will charge the first capacitor C1, causing the voltage at the first node P to rise continuously, as shown in FIG. 5.

At S122, the voltage at the first node P is sensed as a cutoff voltage via the sensing signal line when the driving transistor is turned off. When the first capacitor C1 is charged such that the voltage at the first node P reaches $V_G-V_{th}$, the driving TFT will be turned off. At this time, the driving TFT no longer generates the driving current, and thus the first capacitor C1 will be no longer charged. Therefore, the voltage at the first node P does not change.

At S123, the initial threshold voltage of the driving transistor is obtained according to the threshold test signal and the cutoff voltage.

The threshold voltage of the driving TFT can be calculated by detecting the voltage at the first node P via the sensing signal line when the driving TFT is turned off. That is, the initial threshold voltage $V_{th}$ of the driving transistor is given by:

$$V_{th}=V_G-V_{S1}$$

wherein $V_G$ is a voltage value for the threshold test signal, and $V_{S1}$ is a voltage value of the cutoff voltage.

Figure 6:
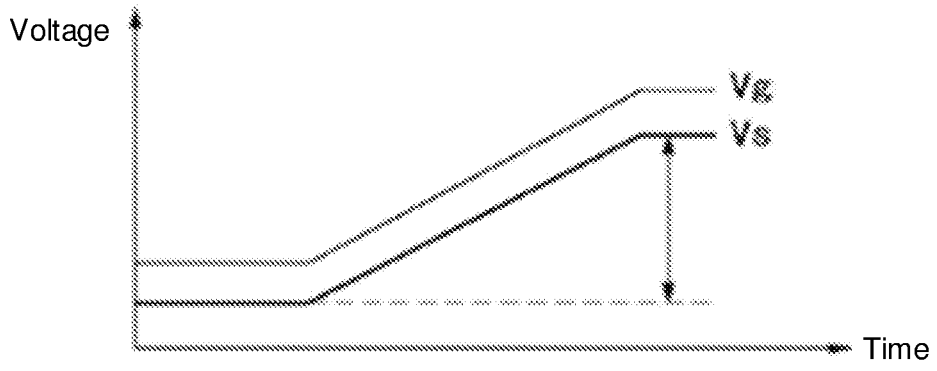
FIG. 6 shows a diagram illustrating voltage between a gate and an electrode coupled to a first node with respect to a driving transistor changing over time in one example of the data signal compensation method according to the embodiments of the present disclosure.

At S130, a compensation test signal is generated according to the initial threshold voltage, and then inputted to the data signal line, so as to obtain an initial compensation value for the mobility. After inputting the compensation test signal, a change in voltage between the gate of the driving TFT and the terminal coupled to the first node P is shown in FIG. 6.

For example, the operation of S130 can further include following steps.

The compensation test signal $V_{data1}$ can be determined as $$V_{data1}=GL+V_{th},$$

wherein GL is a constant and $V_{th}$ is the initial threshold voltage of the driving transistor.

The driving current i generated by the driving transistor in response to inputting the compensation test signal is given by:

$$i=\mu*(V_{data1}-V_{th})^2=\mu*(GL+V_{th}-V_{th})^2=\mu*(GL)^2$$

wherein $\mu$ is an initial mobility for the driving transistor.

Next, a second voltage $U_2$ at the first node is detected after a time interval $T_2$ elapses, so as to obtain the mobility of the driving transistor. The initial compensation value K for the mobility can be obtained according to the preset standard mobility, so that the mobility of the driving transistors may reach the same standard, thereby the brightness of the display panel being uniform.

Among others, K is given by:

$$i = U_2 / T_2; \text{ and}$$

$$K = \frac{\mu_0}{\mu} = (GL)^2 * \mu_0 * U_2 / T_2$$

wherein $\mu_0$ is a preset standard mobility and $U_2$ is the second voltage.

At S140, the test signal is generated according to the initial threshold voltage and the initial compensation value, and inputted to the data signal line. The first voltage at the first node P is sensed as the preset voltage after the first preset time elapses.

For the driving TFT, in a case that the mobility and the threshold voltage of the driving TFT are both normally compensated, the driving TFT may have the output current with a constant value if its input is a given constant value. The first capacitor C1 is charged by the constant output current, and the charging time is the first preset time. At this time, the voltage on the sensing signal line is the first voltage of $Tag_1$. Since the first voltage is a value after the mobility and the threshold voltage are compensated, the first voltage is independent from the mobility and the threshold voltage of the driving TFT. Thus, for any subsequent time, regardless of the changes in the mobility and threshold voltage of the driving TFT, as long as the external compensated mobility and threshold voltage compensation are both correct and the first capacitor is charged for the first predetermined time, the resultant voltage at the first node P should be constant at the value of $Tag_1$. Thus, $Tag_1$ can be used as a value to detect whether the current mobility and the threshold voltage of the driving TFT being compensated correctly or not.

In an example embodiment, when a real-time test signal is input to the data signal line to determine a preset voltage, the display panel may be in an off state, i.e. the pixel circuit does not display any picture. That is, the data signal line has no data signal input. In other example embodiments, the display device may also be in a power-on state, in which case the picture displayed by the pixel circuit is a full black picture, that is, the data signal from the data signal line is at a low level, so that the preset voltage value is more close to the actual voltage in application.

For example, the test signal $V_{data2}$ is given by:

$$V_{data2}=\alpha*K+V_{th}$$

wherein K is the initial compensation value for the mobility of the driving transistor, a is a predetermined constant, and $V_{th}$ is the initial threshold voltage of the driving transistor.

The driving current generated by the driving transistor in response to inputting the test signal $V_{data2}$ is given by $$i'=\mu*(V_{data2}-V_{th})^2=\rho*(\alpha*K+V_{th}-V_{th})^2=\mu*(\alpha*K)^2.$$

The first voltage is given by:

$$V_{S1}=T_1 i'=T_1*\mu*(\alpha*K)^2,$$

wherein $T_1$ is the first preset time.

For example, $\alpha$ may be selected from a value of ½ or 1 depending on a voltage condition such as the threshold voltage value of a light emitting diode.

For example, if α is ½, $$i'=\mu*(V_{data2}-V_{th})^2=\mu*(K/2+V_{th}-V_{th})^2=\mu*(K/2)^2.$$

In an embodiment, the switching sub-circuit may include a switching TFT having a controlling terminal coupled to the scanning signal line, a first terminal coupled to the data signal line, and a second terminal coupled to the controlling terminal of the driving TFT, wherein the driving TFT has a first terminal coupled to the first voltage terminal and a second terminal coupled to the first node P.

In an embodiment, for example, the light emitting sub-circuit may include an AMOLED light emitting device, wherein the light emitting device has an anode coupled to the first node P and a cathode coupled to the real-time voltage terminal. The voltage of the first voltage terminal is greater than the voltage of the real-time voltage terminal, wherein the real-time voltage terminal may be a ground terminal.

In an embodiment, for example, the memory sub-circuit can be a second capacitor C2, wherein the second capacitor C2 has a first electrode coupled to the controlling terminal of the driving TFT, and a second electrode coupled to the first node P.

In a light-emitting period of the pixel circuit, the switching TFT (taking the switching TFT being an NMOS as an example) electrically connects the data signal line to the driving TFT under the control of the scanning signal of a high level from the scanning signal line. The driving TFT (taking the driving TFT being an NMOS as an example) may be turned on in response to the data signal of a high-level from the data signal line, and then generate a driving current. The driving current is input to the light-emitting sub-circuit through the first node P, so as to cause the light-emitting sub-circuit to emit light. When the scanning signal becomes a low level signal, the switching TFT will be turned off, and the second capacitor C2 will maintain the turning-on state of the driving TFT, causing the light emitting sub-circuit to emit light continuously.

Figure 7:
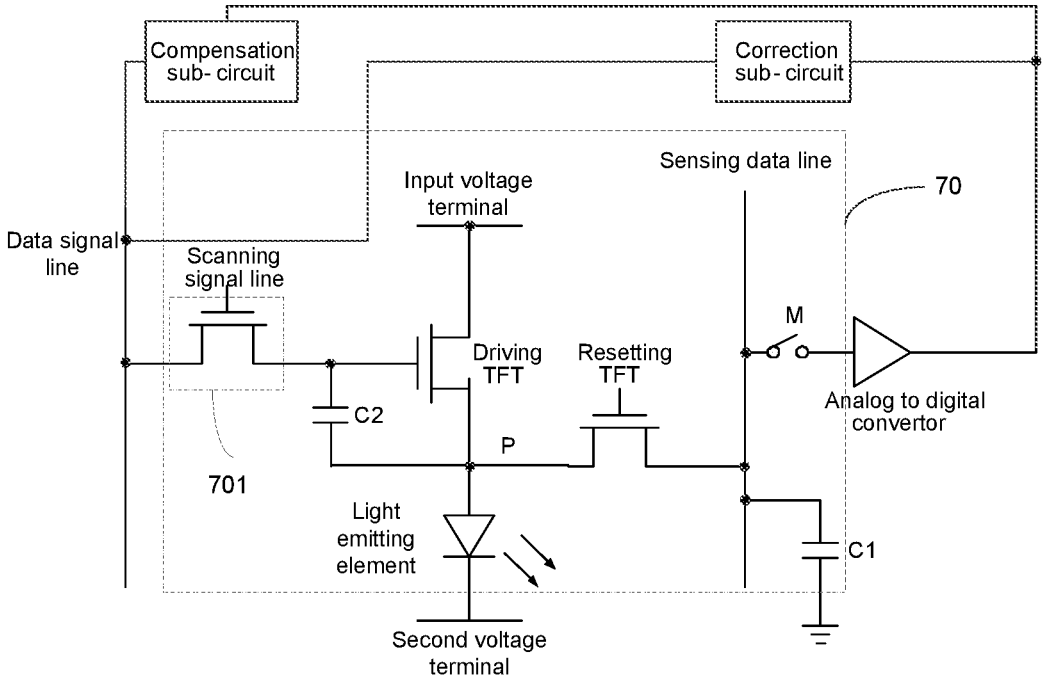
FIG. 7 shows a schematic diagram illustrating an example of a data signal compensation device for a pixel circuit according to the embodiments of the present disclosure.

Similarly, as shown in FIG. 7, the embodiments of the present disclosure further provide a data signal compensation device for a pixel circuit 70. As mentioned above, the pixel circuit 70 may include the switching sub-circuit 701. The data signal compensation device comprises a correction sub-circuit coupled to the data signal line and the sensing signal line respectively. The correction sub-circuit may be configured to input a test signal to the data signal line, detect a real-time voltage at the first node P after a first preset time elapses, compare the real-time voltage with a preset voltage, and in response to the real-time voltage being deviated from the preset voltage, adjust an initial compensation value for a mobility of the driving transistor, so as to make the real-time voltage be consistent with the preset voltage. The preset voltage is set by: writing a threshold test signal to the data signal line, so as to obtain an initial threshold voltage of the driving transistor; generating a compensation test signal according to the initial threshold voltage; inputting the compensation test signal to the data signal line, so as to obtain an initial compensation value for the mobility; generating the test signal according to the initial threshold voltage and the initial compensation value; inputting the generated test signal to the data signal line; and sensing a first voltage at the first node P after the first preset time elapses as the preset voltage.

For example, the data signal compensation device may further include a compensation sub-circuit, which is configured to obtain an initial threshold voltage for the driving transistor by writing a threshold test signal to the data signal line; generate a compensation test signal according to the initial threshold voltage, and input the compensation test signal to the data signal line, so as to obtain an initial compensation value for a mobility; and generate a test signal according to the initial threshold voltage and the initial compensation value, input the generated test signal to the data signal line, and sense a first voltage at the first node after a first preset time elapses as the preset voltage via the sensing signal line.

For example, the compensation sub-circuit and the correction sub-circuit may be coupled to the sensing signal line through a switch M and an analog to digital converter, so as to detect the voltage at the first node P.

Figure 8:
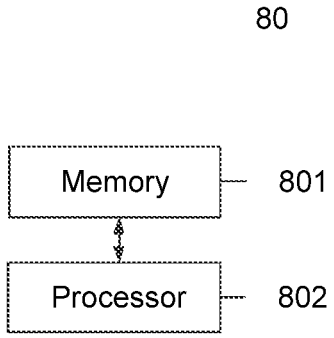
FIG. 8 shows a schematic diagram illustrating another example of the data signal compensation device according to the embodiments of the present disclosure.

According to another aspect of the embodiments of the present disclosure, a data signal compensating device is provided. As shown in FIG. 8, the data signal compensation device 80 may include a memory 801 configured to store instructions, and a processor 802 electrically coupled to the memory, a data signal line, and a sensing signal line. The processor 802 is configured to execute the instructions stored in the memory, so as to input a test signal to the data signal line, and detect a real-time voltage at the first node after a first preset time elapses; compare the real-time voltage with a preset voltage, and in response to the real-time voltage being deviated from the preset voltage, adjust an initial compensation value for a mobility of the driving transistor, so as to make the real-time voltage be consistent with the preset voltage, wherein the preset voltage is an initial threshold voltage of the driving transistor obtained by writing a threshold test signal to the data signal line.

The processor 802 is further configured to generate a compensation test signal according to the initial threshold voltage, and input the compensation test signal to the data signal line, so as to obtain an initial compensation value for the mobility; and generate the test signal according to the initial threshold voltage and the initial compensation value, input the generated test signal to the data signal line, and sense a first voltage at the first node after the first preset time elapses as the preset voltage via the sensing signal line.

Similarly, the embodiments of the present disclosure also disclose a display device including a pixel circuit and the data signal compensating device as described above. The display device can be an OLED display device, and the display device can be used for any product or component having a display function, such as a mobile phone, a tablet computer, a television, a display, a notebook computer, a digital photo frame, a navigator, and the like.

It is apparent that the above-described specific embodiments of the present disclosure are merely illustrative of the embodiments of the present disclosure, and are not intended to limit the embodiments of the disclosed embodiments. Those skilled in the art can make various changes and modifications based on the above description. Any apparent changes and modifications that may be derived from the technical solutions of the embodiments of the present disclosure should be included in the scope of the present disclosure.

We claim:

1. A data signal compensation method for a pixel circuit, the pixel circuit comprising a switching sub-circuit, a driving transistor, a memory sub-circuit, and a detecting sub-circuit, wherein the switching sub-circuit is coupled to a scanning signal line, a data signal line, and the driving transistor, and configured to enable to connect the data signal line to the driving transistor electrically under a control of a scanning signal from the scanning signal line; the driving transistor has a gate electrically coupled to the switching sub-circuit, a drain coupled to a first voltage terminal, and a source coupled to a first node, and is configured to generate a driving current in response to a data signal from the data signal line; the memory sub-circuit is coupled to the gate of the driving transistor and the first node; the detecting sub-circuit comprises a resetting transistor and a first capacitor, the resetting transistor having a controlling terminal coupled to a resetting controlling line, a first terminal coupled to the first node and a second terminal coupled to a first electrode of the first capacitor and a sensing signal line, and the second electrode of the first capacitor being grounded, wherein the data signal compensation method comprises:

inputting a test signal to the data signal line, and detecting a real-time voltage at the first node after a first preset time elapses; and comparing the real-time voltage with a preset voltage, and in response to the real-time voltage being deviated from the preset voltage, adjusting an initial compensation value for a mobility of the driving transistor, so as to make the real-time voltage be consistent with the preset voltage, wherein the preset voltage is set by:

writing a threshold test signal to the data signal line, so as to obtain an initial threshold voltage of the driving transistor;

generating a compensation test signal according to the initial threshold voltage, and inputting the compensation test signal to the data signal line, so as to obtain the initial compensation value for the mobility; and generating the test signal according to the initial threshold voltage and the initial compensation value, inputting the generated test signal to the data signal line, and sensing a first voltage at the first node after the first preset time elapses as the preset voltage.

2. The data signal compensation method of claim 1, wherein writing the threshold test signal to the data signal line so as to obtain the initial threshold voltage of the driving transistor comprises:

inputting the threshold test signal to the data signal line;

sensing a voltage at the first node as a cutoff voltage in a state of the driving transistor being turned off; and obtaining the initial threshold voltage of the driving transistor according to the threshold test signal and the cutoff voltage.

3. The data signal compensation method of claim 2, wherein the initial threshold voltage $V_{th}$ of the driving transistor is given by:

$$V_{th}=V_G-V_{S1}$$

wherein $V_G$ is a voltage value for the threshold test signal, and $V_{S1}$ is a voltage value of the cutoff voltage.

4. The data signal compensation method of claim 1, wherein generating the compensation test signal according to the initial threshold voltage and inputting the compensation test signal to the data signal line so as to obtain the initial compensation value for the mobility comprises:

determining the compensation test signal $V_{data1}$ as:

$$V_{data1}=GL+V_{th}$$

wherein GL is a constant and $V_{th}$ is the initial threshold voltage of the driving transistor;

detecting a second voltage $U_2$ at the first node after a time interval $T_2$ elapses, and obtaining the initial compensation value K for the mobility by:

$$K=\frac{\mu_0}{\mu}=(GL)^2*\mu_0*U_2/T_2$$

wherein $\mu_0$ is a preset standard mobility and $U_2$ is the second voltage; wherein $U_2/T_2$=i, i is the driving current generated by the driving transistor in response to inputting the compensation test signal:

$$i=\mu*(V_{data1}-V_{th})^2=\mu*(GL+V_{th}-V_{th})^2=\mu*(GL)^2$$

wherein μ is an initial mobility for the driving transistor.

5. The data signal compensation method of claim 4, wherein, the test signal $V_{data2}$ is given by:

$$V_{data2}=\alpha*K+V_{th}$$

wherein K is the initial compensation value for the mobility of the driving transistor, α is a predetermined constant, and $V_{th}$ is the initial threshold voltage of the driving transistor, the driving current generated by the driving transistor in response to inputting the test signal $V_{data2}$ is given by:

$$i'=\mu*(V_{data2}-V_{th})^2=\mu*(\alpha*K+V_{th}-V_{th})^2=\mu*(\alpha*K)^2,$$

the first voltage is given by:

$$V_{S1}=T_1*i'=T_1*\mu*(\alpha*K)^2,$$

the preset voltage $Tag_1$ is given by:

$$Tag_1=V_{S1}=T_1*\mu*(\alpha*K)^2,$$

wherein $T_1$ is the first preset time.

6. The data signal compensation method of claim 1, wherein adjusting the initial compensation value for the mobility of the driving transistor so as to make the real-time voltage be consistent with the preset voltage comprises:

decreasing the initial compensation value for the mobility, in response to the real-time voltage being greater than the preset voltage; or increasing the initial compensation value for the mobility, in response to the real-time voltage being less than the preset voltage; and repeating the decreasing or the increasing until the real-time voltage is equal to the preset voltage.

7. The data signal compensation method of claim 1 wherein adjusting the initial compensation value for the mobility of the driving transistor so as to make the real-time voltage be consistent with the preset voltage comprises:

obtaining a deviation $\Delta V_{th}$ for the $V_{th}$ by:

$$\Delta V_{th}=\frac{\alpha*K}{2}*\frac{\Delta Tag}{Tag_1},\text{ and}$$

$$\Delta Tag=Tag_2-Tag_1$$

wherein α is a predetermined constant, K is the initial compensation value for the mobility, $Tag_2$ is the real-time voltage, and $Tag_1$ is the preset voltage; and obtaining a real-time threshold voltage of the driving transistor according to the deviation $\Delta V_{th}$, and inputting the real-time threshold voltage to the data signal line as the initial threshold voltage for the compensation test signal, so as to obtain a real-time compensation value for the mobility.

8. The data signal compensation method of claim 1, wherein the data signal compensation method is performed in response to the data signal line having no data signal input or being provided with a data signal of a low level.

9. A data signal compensation device for a pixel circuit, the pixel circuit comprising a switching sub-circuit, a driving transistor, a memory sub-circuit, and a detecting sub-circuit, wherein the switching sub-circuit is coupled to a scanning signal line, a data signal line, and the driving transistor, and configured to enable to connect the data signal line to the driving transistor electrically under a control of a scanning signal from the scanning signal line; the driving transistor has a gate electrically coupled to the switching sub-circuit, a drain coupled to a first voltage terminal, and a source coupled to a first node, and is configured to generate a driving current in response to a data signal from the data signal line; the memory sub-circuit is coupled to the gate of the driving transistor and the first node; the detecting sub-circuit comprises a resetting transistor and a first capacitor, the resetting transistor having a controlling terminal coupled to a resetting controlling line, a first terminal coupled to the first node and a second terminal coupled to a first electrode of the first capacitor and a sensing signal line, and the second electrode of the first capacitor being grounded, wherein the data signal compensation device comprises:

a correction sub-circuit coupled to the data signal line and the sensing signal line electrically;

wherein the correction sub-circuit is configured to:

obtain an initial threshold voltage for the driving transistor by writing a threshold test signal to the data signal line;

generate a compensation test signal according to the initial threshold voltage, and input the compensation test signal to the data signal line, so as to obtain an initial compensation value for a mobility of the driving transistor; and generate a test signal according to the initial threshold voltage and the initial compensation value, input the generated test signal to the data signal line, and sense a first voltage at the first node after a first preset time elapses as a preset voltage via the sensing signal line.

10. A data signal compensation device, comprising:

a memory configured to store instructions; and a processor electrically coupled to the memory, a data signal line, and a sensing signal line, wherein the processor is configured to execute the instructions stored in the memory to:

input a test signal to the data signal line, and detect a real-time voltage at a first node after a first preset time elapses;

compare the real-time voltage with a preset voltage, and in response to the real-time voltage being deviated from the preset voltage, adjust an initial compensation value for a mobility of the driving transistor, so as to make the real-time voltage be consistent with the preset voltage, wherein the preset voltage is an initial threshold voltage of the driving transistor obtained by writing a threshold test signal to the data signal line, wherein the processor is further configured to:

generate a compensation test signal according to the initial threshold voltage, and input the compensation test signal to the data signal line, so as to obtain the initial compensation value for the mobility; and generate the test signal according to the initial threshold voltage and the initial compensation value, input the generated test signal to the data signal line, and sense a first voltage at the first node after the first preset time elapses as the preset voltage via the sensing signal line.

11. A display panel comprising the data signal compensation device of claim 9.

12. A display device comprising the data signal compensation device of claim 10.

* * * * *